United States Patent [19]

Eckhard

[11] Patent Number: 4,930,437

[45] Date of Patent: Jun. 5, 1990

[54] COATING DEVICE FOR PAPER WEBS HAVING A COATING APPLICATION SPACE SUBDIVIDED BY A VANE

[75] Inventor: Martin Eckhard, Hunxe, Fed. Rep. of Germany

[73] Assignee: J.M. Voith GmbH, Heidenheim, Fed. Rep. of Germany

[21] Appl. No.: 351,283

[22] Filed: May 4, 1989

Related U.S. Application Data

[63] Continuation of Ser. No. 142,495, Jan. 11, 1988, abandoned.

[30] Foreign Application Priority Data

Jan. 10, 1987 [DE] Fed. Rep. of Germany ..... 3700569

[51] Int. Cl.[5] ..... B05C 3/02

[52] U.S. Cl. ..... 118/410; 427/356

[58] Field of Search ..... 118/410, 413; 427/356, 427/358

[56] References Cited

U.S. PATENT DOCUMENTS

| | | | |
|---|---|---|---|
| 4,250,211 | 2/1981 | Damrau et al. | 427/356 |
| 4,405,661 | 9/1983 | Alheld | 118/410 X |
| 4,702,196 | 10/1987 | Kratzberger | 118/413 X |
| 4,834,018 | 5/1989 | Sollinger et al. | 427/356 X |

FOREIGN PATENT DOCUMENTS

| | | | |
|---|---|---|---|
| 3420412 | 12/1985 | Fed. Rep. of Germany | 118/410 |
| 3446757 | 5/1986 | Fed. Rep. of Germany | 118/413 |
| 2158371 | 11/1985 | United Kingdom | 118/413 |

OTHER PUBLICATIONS

Eklund et al.; "The Characteristics of Flow in a Short-Dwell Coater"; Tappi Journal; May 1986; pp. 56–58.

*Primary Examiner*—Shrive Beck
*Assistant Examiner*—Alain Bashore
*Attorney, Agent, or Firm*—Albert L. Jeffers; John F. Hoffman

[57] ABSTRACT

Formed on the doctor element, between a chamber mouth and the paper web respectively the backing roll supporting it, is an application space which relative to the doctor element, that is, on the entrance side of the paper web, is defined by a baffle plate and kept at a pressure which exceeds atmospheric pressure. Between the baffle plate, this application space 2 is subdivided toward the doctor element (coating blade) 1, creating between the end of the vane 2 and the coating blade 1 a gap whose width ranges between 4 mm and 10 mm. This makes it possible to produce a flawless coating application also in the case of very light basis application weights.

6 Claims, 1 Drawing Sheet

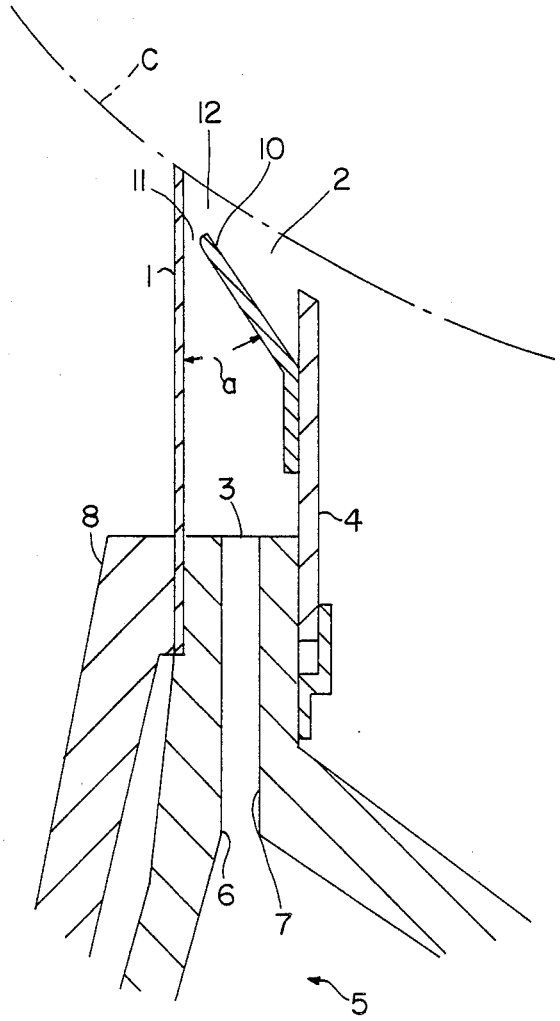
C
12
10
11
2
1
a
3
8
4
6
7
5

COATING DEVICE FOR PAPER WEBS HAVING A COATING APPLICATION SPACE SUBDIVIDED BY A VANE

This is a continuation of application Ser. No. 142,495, filed Jan. 11, 1988 now abandoned.

BACKGROUND OF THE INVENTION

The invention concerns a coating device for coating running paper webs supported by a backing roll, including a doctor element which removes excess coating mixture, a baffle plate located on the entrance side of the paper web relative to the doctor element, a chamber having a mouth for feeding the coating mixture, and an application space defined in part by the doctor element and the baffle plate between the mouth of the chamber and the paper web. Such a coating device is known from the U.S. patent document No. 4,250,211. In these coating devices, the coating mixture is fed from a chamber, pressurized, to an application space which is enclosed on all sides and where a baffle plate on the entrance end exposes relative to the paper web, and respectively the backing roll supporting it, a gap of only such width that a certain pressure of the coating mixture is still maintained in the application space defined in part by the paper web and the doctor element.

It has been demonstrated that specifically in coating very thin papers, but even more so with very low coating weights, for instance basis weights less than 6 g/m$^2$, a uniform coating is very difficult to accomplish.

The problem underlying the invention is to so fashion the device that also in the case of very thin papers and/or specifically very low basis application weights of less than 7 g/m$^2$ a uniform coating can be achieved.

SUMMARY OF THE INVENTION

This problem is solved in a device of the initially cited type by an application space between the mouth or the baffle plate and the web and respective backing roll which is subdivided by a vane which forms a gap with the doctor element which extends along the doctor element essentially across the maximum width of the paper web to be coated or the width of the mouth. The invention will be explained hereafter with the aid of an embodiment illustrated in the figure of the drawing.

BRIEF DESCRIPTION OF THE DRAWINGS

The drawing FIGURE is a schematic sectional view of the coating device which is located on the paper web and respective backing roll.

DESCRIPTION OF THE PREFERRED EMBODIMENT

The figure shows schematically the section of the coating device which is located on the paper web and respective backing roll C, in cross-section (i.e., sectioned in the running and longitudinal direction of the paper web and transverse to the backing roll). Created on the paper web (C), between the doctor element 1 and a front baffle plate 4, is an application space 2 in which the coating mixture still is maintained at a certain pressure relative to the atmosphere. The coating mixture issues out of a mouth 3 which extends along the coating blade 1 representing here the doctor element, from the chamber 5 for the coating mixture and into the application space 2. The baffle plate 4 is attached to the front wall 7 of the mouth. The rear wall 6 of the mouth serves in part as a clamping component for the coating blade 1, with the latter being fixed by means of a clamping lever 8. But this is insignificant for the inventional idea because also other fixing possibilities are given as well, for instance by a pressure hose by means of which the coating blade is mounted in a groove. In this case, of course, the clamping lever 8 could nevertheless be present so as to facilitate the coating blade exchange.

In this case, a vane 10 is attached to the choke plate 4 so that the spacing of the vane (10) from the coating blade (1) increases in the direction from the backing roll (paper web C) to the mouth (3) of the chamber (5). Vane 10 is inclined in a direction toward doctor element 1 and toward backing roll C in the vicinity of the doctor element tip such that a tip portion of vane 10 is closer to backing roll C in the vicinity of the doctor element tip than is a base portion of vane 10. The vane 10 extends at an angle a to the plane extending through the mounting area of the coating blade 1 of between 20° and 55° and exposes on the coating blade 1 a gap 11 of a length which corresponds at least to the width of the mouth 3 which is to be defined parallel to the coating edge of the coating blade, which gap has a height (width) between 4 and 10, preferably between 4.5 and 6.5 mm. Another gap 12 is preferably formed between the end of the vane 10 and the paper web C, which gap is approximately one and one-half to two and one-half times greater than the gap 11 just mentioned.

What is claimed is:

1. In a coating device for applying a coating mixture to a running paper web supported by a backing roll, including a doctor element having a tip in close proximity to the backing roll which removes excess coating mixture, a baffle plate located on the entrance side of the paper web relative to the doctor element, a chamber having a mouth for feeding the coating mixture, and an application space defined in part by the doctor element and the baffle plate between the mouth of the chamber and the paper web, the improvement in combination therewith comprising:

said application space being subdivided by a vane into a first space and a second space, the first space being situated nearer said mouth and the second space being situated nearer said backing roll, said mouth communicating directly with said first space such that the coating mixture is fed initially into said first space, wherein said vane together with said doctor element tip defines a first gap therebetween which extends along said doctor element at least the width of said mouth in a direction parallel to said doctor element, said vane inclined in a direction toward said doctor element and toward the backing roll in the vicinity of the doctor element tip such that a tip portion of said vane is closer to the backing roll in the vicinity of the doctor element tip than a base portion of said vane, said first gap having a width between said vane and said doctor element in the range of about 4 mm to 10 mm, said vane and said web defining a second gap therebetween having a width in the range of about 1.5 to 2.5 times the width of said first gap.

2. Coating device of claim 1, in which said first gap has a width in the range of about 4.5 mm to 6.5 mm.

3. Coating device according to claim 1, in which said doctor element is a coating blade.

4. Coating device according to claim 2, in which said doctor element is a coating blade.

5. Coating device according to claim 1, in which said vane is inclined, at least adjacent said backing roll, toward said doctor element at an angle between about 20° to 55° with respect to said doctor element, with the distance between said vane and said doctor element increasing in the direction from said backing roll toward said mouth.

6. Coating device according to claim 2, in which said vane is inclined, at least adjacent said backing roll, toward said doctor element at an angle between about 20° to 55° with respect to said doctor element, with the distance between said vane and said doctor element increasing in the direction from said backing roll toward said mouth.

* * * * *